US008844065B2

(12) United States Patent
Osgood

(10) Patent No.: US 8,844,065 B2
(45) Date of Patent: Sep. 30, 2014

(54) SINGLE KNOT HAIRNET

(75) Inventor: Michelle J. Osgood, East Fairfield, VT (US)

(73) Assignee: One Knot Hairnet LLC, East Fairfield, VT (US)

( * ) Notice: Subject to any disclaimer, the term of this patent is extended or adjusted under 35 U.S.C. 154(b) by 470 days.

(21) Appl. No.: 12/977,476

(22) Filed: Dec. 23, 2010

(65) Prior Publication Data

US 2011/0145976 A1 Jun. 23, 2011

Related U.S. Application Data

(60) Provisional application No. 61/289,900, filed on Dec. 23, 2009.

(51) Int. Cl.

| | |
|---|---|
| ***A42B 1/04*** | (2006.01) |
| ***A45D 8/40*** | (2006.01) |
| ***A42B 3/10*** | (2006.01) |

(52) U.S. Cl.

CPC . *A42B 1/043* (2013.01); *A45D 8/40* (2013.01); *A42B 3/10* (2013.01)

USPC ..... 2/174

(58) Field of Classification Search

USPC ..... 2/174, 207; D2/865, 867, 880, 875; 132/273, 274

See application file for complete search history.

(56) References Cited

U.S. PATENT DOCUMENTS

| | | | | | |
|---|---|---|---|---|---|
| 961,471 | A | * | 6/1910 | Weill | 132/274 |
| 1,504,100 | A | * | 8/1924 | Danubio | 132/274 |
| 2,183,963 | A | * | 12/1939 | Sidney | 132/274 |
| 2,346,796 | A | * | 4/1944 | Shaw | 132/274 |
| 2,428,071 | A | * | 9/1947 | Goldsmith | 132/274 |
| 2,534,351 | A | * | 12/1950 | Herschensohn | 132/274 |
| 2,556,576 | A | * | 6/1951 | De Carolis | 132/274 |
| 3,392,737 | A | * | 7/1968 | Fefferman | 132/274 |
| 3,750,681 | A | * | 8/1973 | Claunch | 132/274 |
| 4,683,596 | A | * | 8/1987 | Cole | 2/174 |
| D394,736 | S | | 6/1998 | Ussery et al. | |
| 5,890,229 | A | * | 4/1999 | Esposito | 2/174 |
| D473,365 | S | * | 4/2003 | Bias | D2/867 |
| D572,438 | S | * | 7/2008 | Chun | D2/883 |
| 2008/0109938 | A1 | * | 5/2008 | Douglas | 2/174 |
| 2009/0065022 | A1 | * | 3/2009 | Park | 132/274 |

* cited by examiner

*Primary Examiner* — Khoa Huynh

*Assistant Examiner* — Andrew W Collins

(74) *Attorney, Agent, or Firm* — Dunkiel Saunders Elliott Raubvogel & Hand PLLC; Justin W. McCabe

(57) ABSTRACT

A hairnet suitable for retaining a person's hair in a desired position while providing comfort to the person when wearing a tight-fitting helmet or other headgear that comes into contact with the hairnet. The hairnet may include a net portion with a band connected along one edge of the net portion. The ends of the band then may be brought together, along with portions of the net portion, to a cinch point and bound with a cinch structure. The resulting cinch point may be advantageously worn at the nape of the neck, thus avoiding pressure points on other parts of the person's head. Methods of constructing the hairnet and using the hairnet with a helmet are also disclosed. Embodiments of the present hairnet may be made with materials used in the construction of conventional hairnets because of their familiarity, breathability, and generally disposable nature.

12 Claims, 3 Drawing Sheets

SINGLE KNOT HAIRNET

RELATED APPLICATION DATA

This application claims the benefit of priority of U.S. Provisional Patent Application Ser. No. 61/289,900, filed Dec. 23, 2009, and titled "Single Knot Hairnet," which is incorporated by reference herein in its entirety.

FIELD OF THE INVENTION

The present invention generally relates to the field of hair coverings. In particular, the present invention is directed to a hairnet having a single knot.

BACKGROUND

Hairnets are used by workers in a variety of contexts, e.g., during food processing, food preparation, and in medical and chemical laboratories. Few requirements, if any, govern the design and construction of hairnets. The way the hairnet looks when on a person's head, is generally irrelevant so long as the hairnet performs the function desired. In certain contexts, however, such as equestrian riding, speed skating, and cycling, hairnets are worn under helmets and in these applications hairnets can serve both aesthetic and functional purposes.

Known hairnets include two cinch points. In use, one cinch point is positioned on the forehead and one is positioned near the nape. The cinch point in the front of known hairnets, i.e., the one positioned on the forehead, has been a source of frustration and discomfort for users wearing the hairnet underneath a tight-fitting helmet.

SUMMARY OF THE INVENTION

In a first aspect, the present disclosure is directed to a hairnet for covering hair on a head, the hairnet comprising: a band having a first end and a second end; a net portion having an edge connected to the band; and a cinch point at which first and second ends of the band and sections of the net portion are connected; wherein the hairnet includes only the cinch point and not a second cinch point for securing together sections of the net portion other than those secured at the cinch point.

In another aspect, the present disclosure is directed to a method of using a hairnet, comprising: providing a hairnet including a net portion having a plurality of edges, a band affixed to one of the plurality of edges, the band having first and second ends, and only one cinch point at which portions of the net portion are secured together; positioning the hairnet on the head of a user so that the cinch point is positioned adjacent the nape of the user; and positioning on the head of a user a helmet configured to have a shape closely conforming to the user's head so that the hairnet is positioned between the helmet and the user's head.

In yet another aspect, the present disclosure is directed to a method of constructing a single knot hairnet, comprising: providing a net having a plurality of edges; disposing an elastic material to one edge of the net; cutting the net and the elastic material to have a length that creates a net with a generally rectangular shape; and securing together the two opposing ends of the elastic material and portions of the remaining edges.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

DETAILED DESCRIPTION

Figure 2:
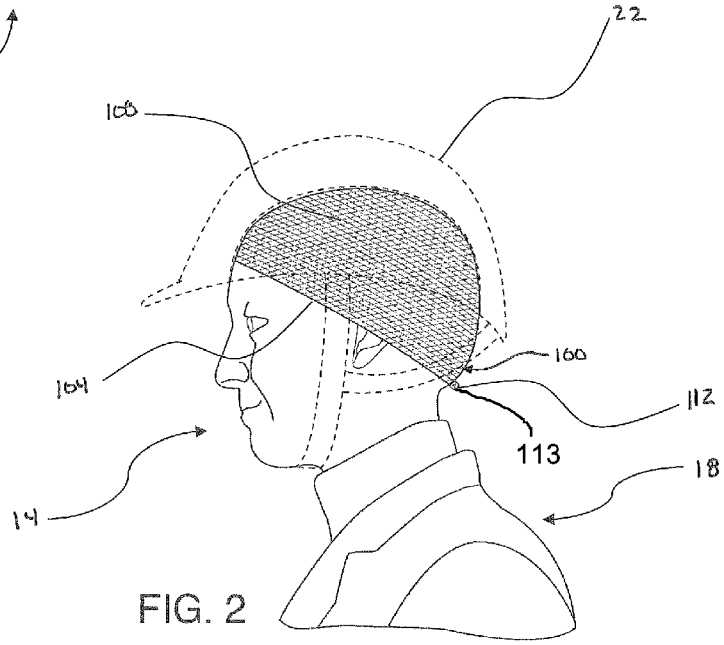
FIG. 2 is a perspective view of a hairnet worn by a person under a tight-fitting helmet according to an embodiment of the present invention.
Figure 3:
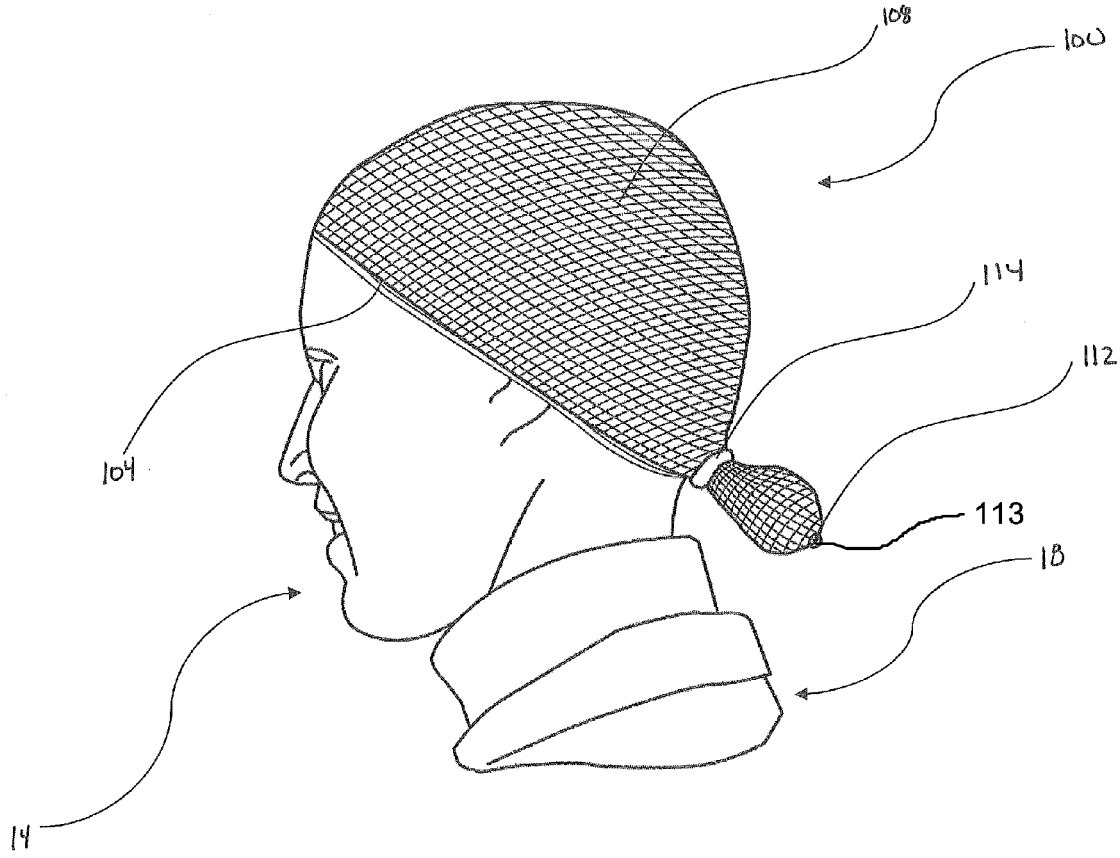
FIG. 3 is a perspective view of a hairnet worn on a head according to an embodiment of the present invention.
Figure 5:
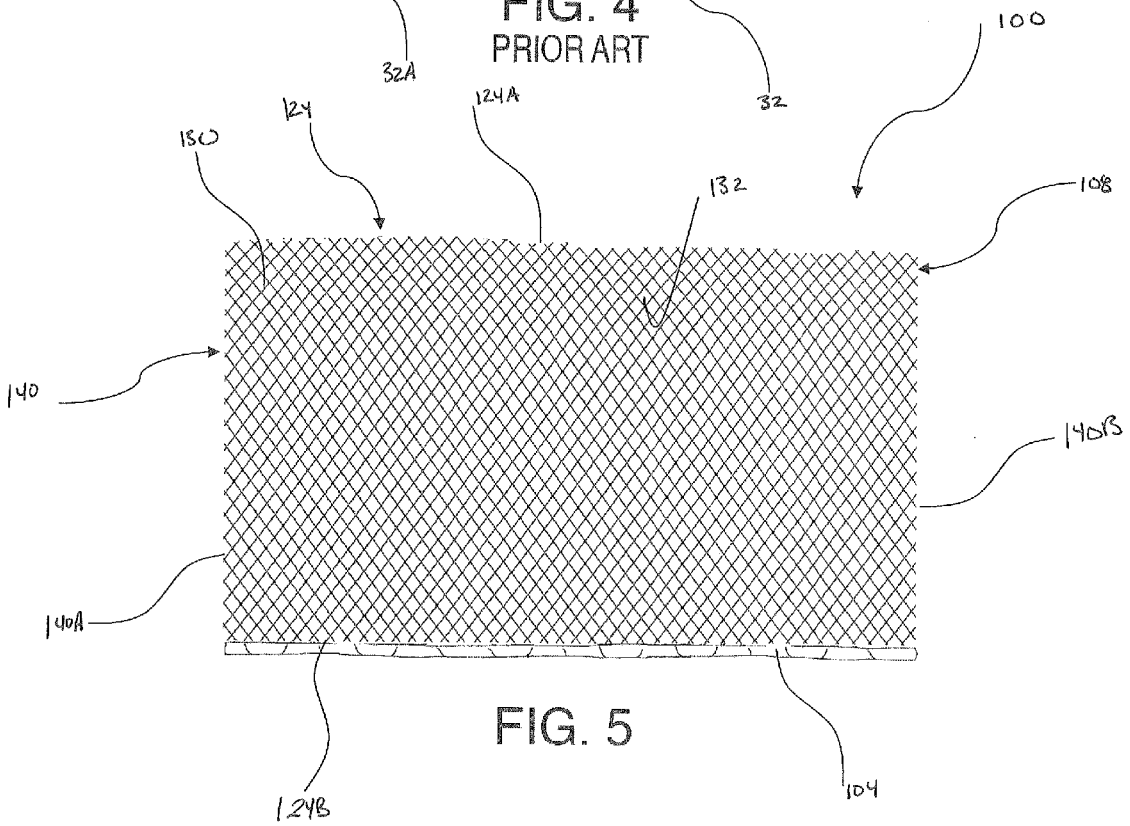
FIG. 5 is a plan view of a hairnet according to an embodiment of the present invention.

Generally, a hairnet constructed in accordance with the present disclosure is suitable for retaining a person's hair in a desired position while providing comfort to the person when wearing a tight fitting helmet or other headgear that comes into contact with the hairnet. Embodiments of the present hairnet may be made with materials used in the construction of conventional hairnets because of their familiarity, breathability, and generally disposable nature. However, the hairnet of the present disclosure only has one cinch structure or knot instead of two or more, which improves the comfort of the hairnet when wearing certain types of headgear. As described below, FIGS. 2, 3, and 5 illustrate several exemplary embodiments of such a hairnet. In a particular example, the single cinch structure of the hairnet is placed in the back of the head near the nape. Equestrian riding helmets, which are required in some events for safety, sometimes fit very tightly to the rider's head. With its single knot construction, a hairnet of the present disclosure avoids creation of a pressure point in the forehead of the rider—a pressure point that would typically be induced by the additional knot found in prior art hairnets.

In connection with the following description, like numbers will be used in the drawings to identify like structure, to the extent practicable.

Figure 1:
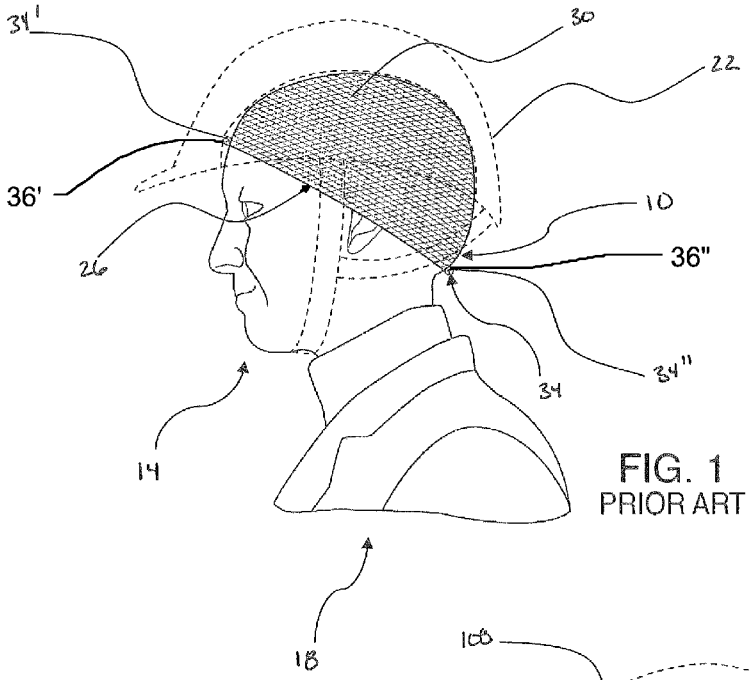
FIG. 1 PRIOR ART
FIG. 1 is a perspective view of a prior art hairnet worn by a person under a tight-fitting helmet.
Figure 4:
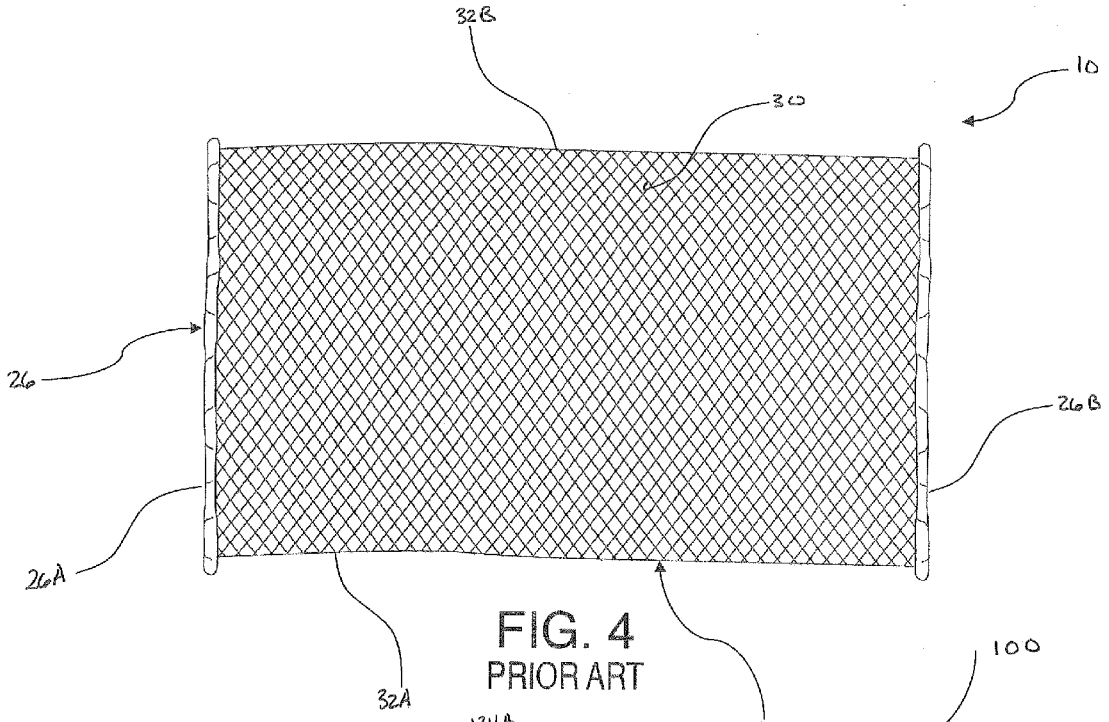
FIG. 4 PRIOR ART
FIG. 4 is a plan view of a prior art dual cinch hairnet with the cinch removed and the hairnet spread out.

Referring now to the drawings, FIGS. 1 and 4 show a prior art hairnet 10 worn on the head 14 by a person 18 who is wearing a tight-fitting helmet 22. Generally, prior art hairnet 10 includes a pair of parallel running elastic bands 26, i.e., elastic bands 26A and 26B (best seen in FIG. 4), that act to conform the periphery of hairnet 10 to head 14. As seen in FIG. 4, hairnet 10 has a net portion 30 that, in use, extends over head 14 and is attached to bands 26A and 26B. Net portion 30 also has two edges 32, i.e., edges 32A and 32B, that extend transversely, e.g., perpendicular, to and intersect, bands 26A and 26B. Prior art hairnet 10 also includes two cinch points 34, which in use, as shown in FIG. 1, are located at the front (cinch point 34') and back (cinch point 34") of head 14, i.e., the forehead and the nape. Cinch structures 36' (located at cinch point 34') and 36" (located at cinch point 34") connect the corresponding ends of each of elastic bands 26A and 26B as well as gather together portions of net portion 30 adjacent edges 32A and 32B. When a tight-fitting helmet 22 is positioned on head 14, a front portion of the helmet can press on front cinch structure 36', thus creating a pressure point on head 14 in the forehead region.

Referring to FIGS. 2 and 5, FIG. 2 shows an exemplary embodiment of a hairnet 100 in a setting similar to that shown with respect to FIG. 1. Thus, hairnet 100 is shown on the head 14 of person 18 who is wearing a tight-fitting helmet 22. In one embodiment, hairnet 100 may have a single band 104 that aids in conforming the hairnet to the configuration of head 14. Hairnet 100 also includes a net portion 108 that is at least partially connected to band 104 and forms the structure around head 14 (best seen in FIG. 5). Hairnet 100 may also have a cinch point 112 at which a cinch structure 113 secures together the two ends of band 104 and also gathers together the unbanded edges of net portion 108 and sections of the net portion adjacent such edges. Thus, as is readily apparent from FIG. 2, when hairnet 100 is worn by person 18 with helmet 22, the front portion of the hairnet has a substantially uniform thickness and so does not create a pressure point in the forehead of person 18 or elsewhere, unlike prior art hairnets such as hairnet 14 illustrated in FIG. 1. Hairnet 100 may optionally include a tie 114 that allows person 18 to more closely conform hairnet 100 to head 14 (best seen in FIG. 3). The various elements of hairnet 100 discussed briefly above are described in more detail below.

Band 104 may be constructed of materials known in the art that allow the band to conform to the shape of a head 14 when hairnet 100 is in use and permit ready attachment of net portion 108 to the band during manufacture of the hairnet. In one embodiment, band 104 is constructed, at least in part, out of a generally elastic material, such as elastane (identified by the trademarks Spandex® or Lycra®). Band 104 may also be constructed out of natural fibers, e.g., cotton, wool, etc., either alone or mixed with natural or synthetic elastic filaments such as natural rubber or synthetic rubber, respectively.

Band 104 may be sized and dimensioned based on the intended use of hairnet 100. For instance, if it is desired that hairnet 100 have a shear profile and thus a minimal band width, band 104 may have a relatively small thickness, e.g., less than about 1 mm. Alternatively, if band 104 is intended for use in a more rigorous environment, such as equestrian riding, the band may have a relatively greater thickness, e.g., about 5 mm to 1 cm. In any event, as will be apparent to those skilled in the art, the size and configuration of band 104 is typically a trade-off between the maximum durability of a given material at a given thickness versus the style, appearance, and utility desired for hairnet 100.

As shown in FIG. 5, band 104 may extend along, and be attached to, at least in part, a long side 124B of net portion 108, in contrast to prior art hairnet 10, which places bands 26A and 26B on the short sides of net 30 and thus requires two cinch points 34. The location of band 104 along the long side of 124B of net portion 108 allows for a single cinch point 112 and thereby facilitating the use of cinch structure 113 and the creation of hairnet 100 with a shape that generally conforms to the shape of head 14. Unlike prior art hairnets, hairnet 100 does not include a second cinch point positioned diametrically opposite cinch point 112, which avoids creation of a pressure point at the forehead region of head 14 of person 18 when the hairnet is used tight-fitting helmet 22. In an exemplary embodiment, band 104 includes some of the same materials as net portion 108 (discussed more fully below) and further includes one or more linear elastic members interwoven into the materials. In an alternative embodiment, band 104 may include several lengths of material that lie adjacent one another in substantially collinear relationship.

Net portion 108 may be made from partially or entirely interwoven strands 130 that are constructed so as to define a plurality of openings 132. Interwoven strands 130 may be made from either natural fibers such as cotton or wool or synthetic materials such as PVC, nylon, and polyester, and the interwoven strands may be relatively elastic or relatively inelastic. The choice of materials for interwoven strands 130 may depend on a number of factors such as the cost, quality, and/or elasticity required. In one embodiment, interwoven strands 130 are made from polyester.

In one embodiment, net portion 108 has a rectangular shape (best seen in FIG. 5) prior to assembly, thus having four outside edges, i.e., two short edges 140A and 140B and two long edges 124A and 124B. The length of short edges 140 and long edges 124 may be determined by the size of hairnet 100 that is desired. In an exemplary embodiment of net portion 108, the ratio of long edges 124 to short edges 140 is about 2 to 1. In an alternative embodiment, net portion 108 may be elliptical in shape. In this example, band 104 may be disposed along a portion of the edge of the ellipse that runs, at least in part, parallel to the longest diameter of the ellipse.

Generally, at cinch point 112, cinch structure 113 secures together (i) sections of net portion 108 adjacent the long edge 124 opposite band 104, e.g., long edge 124A, and short edges 140 and (ii) the ends of the band. For example, unassembled hairnet 100 shown in FIG. 5 may be assembled by bringing together short edges 140A, 140B, and long edge 124A with the ends of band 104. Cinch structure 113 may be a metal clasp, fibrous interwoven lashing, glue, solder, or other fastener, adhesive or other attachment mechanism known in the art. In some cases, depending on material used for interwoven strands 130, it may be desirable to fuse together the material at edges 124 and 140, whether by application of heat, by use of adhesives or otherwise, typically but not necessarily before cinch structure 113 is included with hair net 100.

Turning now to the manufacture of hairnet 100 and referring to FIGS. 3 and 5, the hairnet in an unclasped state (as seen in FIG. 5), is gathered together so that portions or all of one long edge 124 and short edges 140 of net portion 108 and the two ends of band 104 are joined. Cinch point 112 is then used to secure together these elements of hairnet 100.

In use, a person 18 stretches hairnet 100 at band 104 (now generally annular in appearance), to be slightly larger than their head 14. Hairnet 100 is then placed on head 14 so that cinch point 112, and therefore cinch structure 113, resides proximate the nape and band 104 extends across the forehead, side of the head, ears and back of the head. The person 18 can then position helmet 22 on head 14 overtop hairnet 100. As a result of the construction of hairnet 100 described above, positioning the hairnet on the head of person 18 as described above results in an even, i.e., un-bunched, placement of the hairnet across the person's forehead, i.e., the hairnet has a generally uniform thickness across the forehead. As discussed above, because hairnet 100 in use has a substantially uniform thickness across the forehead of person 18, and no cinch point or other projecting structure is present in this portion of the hairnet, formation of a pressure point in the forehead region is avoided. As shown in FIG. 3, in the event that hairnet 100 is too large for head 14, a tie 114 may be used to corral any excess sections of the hairnet and enclosed hair from head 14.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A hairnet for covering hair on a head, the hairnet comprising, when in an unassembled state:

a band having a first end and a second end;

a net portion having an outer perimeter, said outer perimeter having a plurality of sides, wherein said band is positioned along and secured to a single one of said plurality of sides; and the hairnet comprising, when in an assembled state:

a non-moveable cinch point at which first and second ends of said band and sections of said net portion are connected, wherein said hairnet includes only said cinch point and not a second cinch point for securing together sections of said net portion other than those secured at said cinch point.

2. A hairnet according to claim 1, wherein said net portion has at least three sides in the unassembled state.

3. A hairnet according to claim 2, wherein said net portion has four sides in the unassembled state such that said net portion has a generally rectangular shape.

4. A hairnet according to claim 3, wherein said band is connected to a long side of said net portion in the unassembled state.

5. A hairnet according to claim 1, wherein said net portion has a generally elliptical shape in the assembled state.

6. A hairnet according to claim 1, further including a metal clasp disposed at said cinch point.

7. A hairnet according to claim 1, further including a fibrous interwoven lashing disposed at said cinch point.

8. A hairnet according to claim 1, wherein said net portion and said band comprise a first material.

9. A hairnet according to claim 8, wherein said first material is a natural or synthetic fiber.

10. A hairnet according to claim 8, wherein said band has several lengths of said first material that lie adjacent one another in substantially collinear relationship.

11. A hairnet according to claim 1, wherein said band has a thickness of about 1 mm to about 1 cm.

12. The hairnet of claim 1, wherein said cinch point fixedly couples said first end of said band to said second end of said hand, and gathers together and couples other ones of said plurality of sides to said first and second ends of said band in the assembled state.

* * * * *